US005169157A

United States Patent [19]

Salmon

[11] Patent Number: 5,169,157

[45] Date of Patent: Dec. 8, 1992

[54] TARGET HOLDER

[76] Inventor: Michael E. Salmon, 199 Aberdeen, Spartanburg, S.C. 29302

[21] Appl. No.: 760,198

[22] Filed: Sep. 16, 1991

[51] Int. Cl.[5] ..... F41J 1/10

[52] U.S. Cl. ..... 273/407; 242/75.45

[58] Field of Search ..... 273/404, 406, 407, 408, 273/409, 410; 242/75.45, 68.4

[56] References Cited

U.S. PATENT DOCUMENTS

| | | | |
|---|---|---|---|
| 398,186 | 2/1889 | Rehfuss | 273/404 |
| 840,610 | 1/1907 | Easdale | 273/404 |
| 1,981,293 | 4/1934 | Varrelman | 273/406 X |
| 3,080,166 | 3/1963 | Clark | 273/407 |
| 3,415,519 | 12/1968 | Hand | 273/407 |
| 3,591,372 | 7/1970 | Vogelaere | 273/404 |
| 4,821,974 | 4/1989 | Poehlein | 242/68.4 |
| 4,921,250 | 5/1990 | Ayres | 273/406 X |

*Primary Examiner*—William H. Grieb
*Attorney, Agent, or Firm*—Brooks & Kushman

[57] ABSTRACT

An automatic target holder is provided for positioning targets for projectiles at a location remote from a shooter. The target holder includes a housing having a relatively low silhouette and a target support removably mounted upon the housing for positioning a target in a substantially planar firing position normal to a path of a projectile fired by the shooter. A target drive mechanism is located within the housing and is remotely operable by the shooter to advance a target roll to move a new target into the firing position. The target support structure and the housing is oriented outboard of the target in the firing position providing an unobstructed path for the projectile as it passes through the target. The preferred embodiment is provided with a target illumination panel positioned behind the target and shiftable between an inactive position out of the projectile path and an active position behind the target in order to increase the visibility of the projectile holes formed in the target.

32 Claims, 9 Drawing Sheets

TARGET HOLDER

TECHNICAL FIELD

The invention relates to target holders and more specifically to automatic target holders which are remotely operable by the shooter.

BACKGROUND ART

Target holders for roll type targets which are remotely operable by a shooter are over 100 years old. A very early target holder is shown in U.S. Pat. No. 398,186, Rehfuss, patented in 1889. The Rehfuss device was provided with a rigid metal plate surrounding the periphery of the active target to protect the unused target roll and drive mechanism and included a bullet trap behind the active target to catch bullets fired therethrough. The targets can be remotely advanced by a shooter by pulling a long string which operates a ratchet mechanism which unwinds the target roll. A similar mechanism was patented in 1907 by Easdale, U.S. Pat. No. 840,610. The Easdale device also utilized a bullet trap behind the active target and the string for operating a ratchet mechanism to advance the target.

There are several more modern bullet trap type target holders which utilize a motor to advance the targets remotely, namely, U.S. Pat. No. 1,981,293, Varrelman; U.S. Pat. No. 3,591,372, Vogelaere, and U.S. Pat. No. 4,921,250, Ayres. Varrelman is a relatively large and heavy target holder with a metal back-stop and a bullet trap. Vogelaere is a portable light-weight training device for use with dummy ammunition. A nylon shield "S" provides a back-stop for projectiles having traveled through the roll-type paper target. Since the Vogelaere device is intended for use with dummy ammunition, there is no effort made to protect the mechanism from damage from being struck by bullets. The Ayres patent illustrates an automatic target holder which utilizes folded pin-feed paper which is advanced by a motor in front of a bullet trap. Additionally, U.S. Pat. No. 1,928,768, Sell and U.S. Pat. No. 4,583,744, Tolliver, illustrate roll-type targets which are manually advanced by the shooter and are positioned in front of a solid backstop.

DISCLOSURE OF THE INVENTION

An object of the present invention is to provide an automatic target holder to enable a shooter to change targets from a remote location.

Another object of the present invention is to enhance the visibility of the projectile holes formed in the target so that the shooter can observe the hole location from a distance.

Yet another object of the present invention is to provide a target holder for use with roll type targets where the target in the firing position is always maintained secure and taut. These objects, as well as other features and advantages of the present invention are shown in the accompanying specification.

Accordingly, a target holder of the present invention is designed for positioning a target for projectiles at a location remote from the shooter. The target holder includes a housing, having a relatively low silhouette when viewed along the path of the projectile, and a target support removably mounted upon the housing for positioning a target in a roll of targets in a generally vertical plane normal to the path of the projectile. A target support structure and the housing are oriented relative to the target in the firing position so as to provide an unobstructed path for the projectile as it passes through the target. A target drive mechanism is located within the housing, to advance the target roll to move a new target to the firing position in response to a signal supplied by the remotely located shooter.

In the preferred embodiment of the invention, the target holder includes a illumination panel shiftable between an inactive position out of the projectile path and an active position behind the target so as to increase the visibility of the projectile holes formed in the target. The illumination panel is shifted by an illumination panel drive mechanism which is remotely operable by the shooter.

The roll of targets in the preferred embodiment is supported by the target support horizontally above the target in the firing position. A take-up roll is connected to the target drive mechanism and is located in the housing below the target in the firing position. A target tensioner engages the roll of targets in order to apply a frictional load upon the roll which varies as the function of a roll diameter.

One embodiment of the roll of targets used by the target machine of the present invention is likewise unique. The roll of targets is made of an elongated strip of paper having a series of targets printed thereon. The elongated strip is formed into a cylindrical roll with one end of the roll recessed causing the overall length of the cylindrical roll to decrease as the elongated strip is unwound. The variable length roll design enables the tensioner to automatically adjust tension upon the roll as a function of the roll length.

BEST MODES FOR CARRYING OUT THE INVENTION

Figure 1:
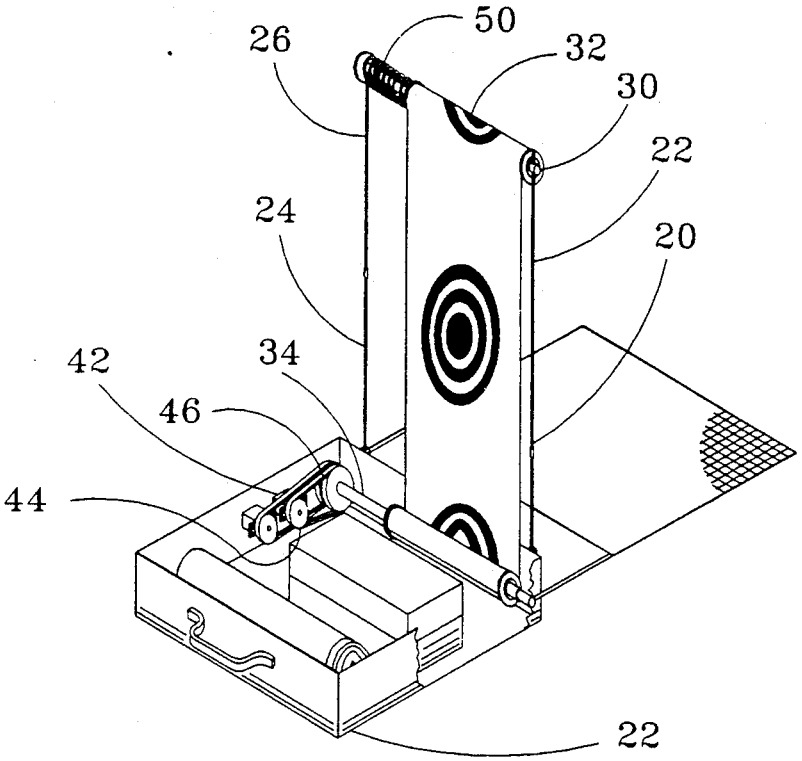
FIG. 1 is a perspective view illustrating a preferred embodiment of the invention in the erected position.

In FIG. 1, the target holder 20 of the present invention is illustrated in an erect ready-for-use condition. Housing 22 has a width of 17 inches and a height of 3.8 inches providing a low silhouette with minimal frontal area. The housing when in use has a substantially flat bottom for placement on a support surface such as the ground or the like. The target support structure 24 is removably mounted upon the rearward most side of housing 22 for positioning a target in a generally vertical plane visible to a remote shooter.

Target support structure 24 is made up of a pair of uprights 26 and 28 and a horizontal cross member 30 which collectively form an arch. A cylindrical roll of targets 32 is coaxially installed upon the horizontal cross member 30. The roll of targets is a cylindrically wound elongated strip of paper having a series of targets, i.e. bulls-eyes or the like, printed thereon. The length of the target roll is less than the transverse distance between the right and left uprights 26 and 28. In the preferred embodiment illustrated, the uprights are spaced apart 16.3 inches and the target as the width is 14.4 inches. One end of the elongated strip forming the roll of targets is attached to take-up roll 34 which is oriented in the housing and is generally parallel to and below the horizontal cross member 30. The segment of the elongated strip forming the roll of targets which spans between the take-up roll and the roll targets 32 forms a generally vertically plane which is normal to the path of projectile travel.

Figure 2:
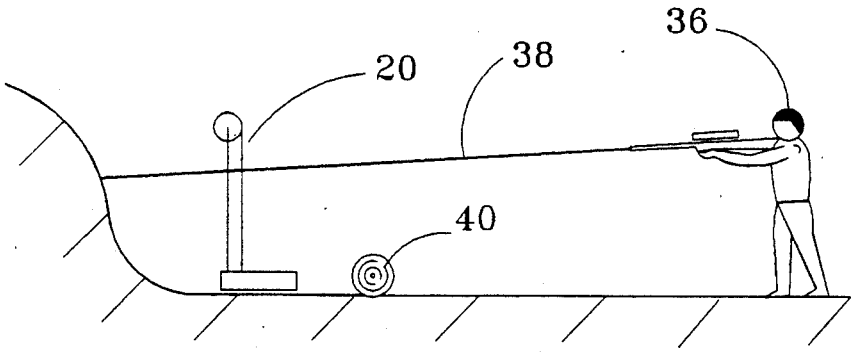
FIG. 2 is a diagrammatic side elevation illustrating the orientation of the target holder relative to a remote shooter.

The orientation of the target holder 20 relative to a remote shooter 36 is illustrated in FIG. 2. Target holder 20 is placed at a remote location from the shooter 36, such as a rifle range or the like. As shooter 36 fires a gun at the target held by the target holder, a projectile will follow a generally horizontal path 38 as illustrated in FIG. 2. Ideally, the target holder will be located in front of a back stop, such as a earthen berm. In order to prevent damage to the target holder by a wild shot, a log 40 or the like can be positioned in front of a target holder to prevent damage to the housing and the components contained therein.

In use, shooter will fire the desired number of shots at the target which is currently in the firing position. After the target is scored remotely using a spotting scope the user can remotely change targets by operating radio controlled drive motor 42. Drive motor 42 rotates a pulley 44 which drives the belt 46. Bolt 46 rotates pulley 48 which is affixed to take-up roll 34. As the drive motor rotates take-up roll 34 in the clockwise direction as illustrated in FIG. 1, the target in the firing position is wound about the take-up roll and a new target from the target roll is moved into the firing position.

In order to maintain the target in the firing position in a generally vertical plane, it is necessary to control the tension required to unwind a roll of targets relative to the target support structure 24. Tensioner 50 is provided upon the target support structure in order to axially load the cylindrical roll of targets to maintain the desired unwinding load. The tension must not be so tight as to inhibit the target from advancing yet the tension should be high enough to prevent the target from unwinding due to wind load.

The roll of targets is made of paper having a thickness between 4 and 13 mills. Preferably, a target grade paper typically referred to as "chip" paper will be utilized so that the projectiles will form clean holes in the target without tearing and fraying about the holes edges. Suitable paper is available from any one of a number of paper suppliers such as Frank Parsons Paper Co. of Andover, Md. While typically standard paper targets have a thickness of 12.5 mills, the paper thickness is needed for mounting purposes. The thinner paper works quite satisfactorily in conjunction with the target holder of the present invention and enables a significantly greater number of targets to be placed on a given size roll. With a 5.5 mill paper thickness, a roll of 85 14 inch targets will have a diameter of 3.0 inches when wounded upon a 0.875 inch diameter core.

In the preferred embodiment of the invention illustrated in FIGS. 1–6, an illumination panel 52 is provided to enable the shooter to increase the visibility of projectile holes performed in the target. The illumination panel is pivotably attached to the housing and is rotatable between an inactive position, shown in dotted outline in FIG. 3 out of the path reprojectile passing through the target, and an active position 54 behind the target. The illumination panel is preferably provided with a brightly colored panel sheet 56 such as florescent orange or green. When the illumination panel is raised to the active position behind the target, projectile holes formed in the target become highly visible particularly those holes in the black which are frequently hard to see when the target's position in front of a dark berm.

Figure 5:
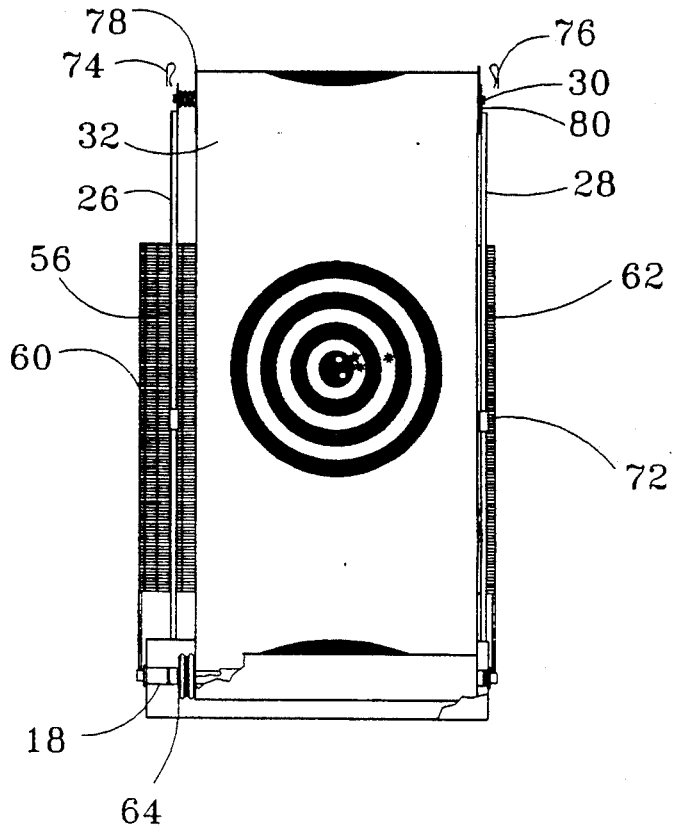
FIG. 5 is a front view of the target holder.
Figure 6:
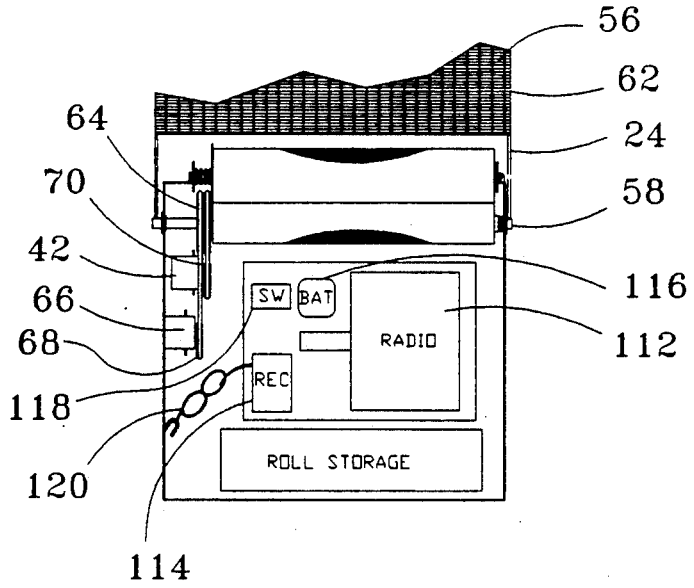
FIG. 6 is a partial plan view of the target holder.

Illumination panel 52 is made up of illumination panel axle 58 which extends through the housing and is preferably coaxially oriented within take-up roll 34. The illumination panel further includes right and left illumination panel frame members 60 and 62 between illumination panel sheet 56 is stretched. Illumination panel sheet 56 is preferably formed of a florescent orange fabric such as urethane coated nylon material made by commonly used in highway flags. The illumination panel is raised between the inactive and active position by rotating an illumination panel axle 58. An illumination panel axle is provided with a axle pulley 64 as shown in FIGS. 5 and 6, drive by illumination panel drive motor 66 having a drive pulley 68 and a drive belt 70. Illumination panel drive motor 66 is remotely operated by shooter using a radio transmitter which enables the panel to be raised or lowered or stopped in an intermediate position therebetween.

Figure 3:
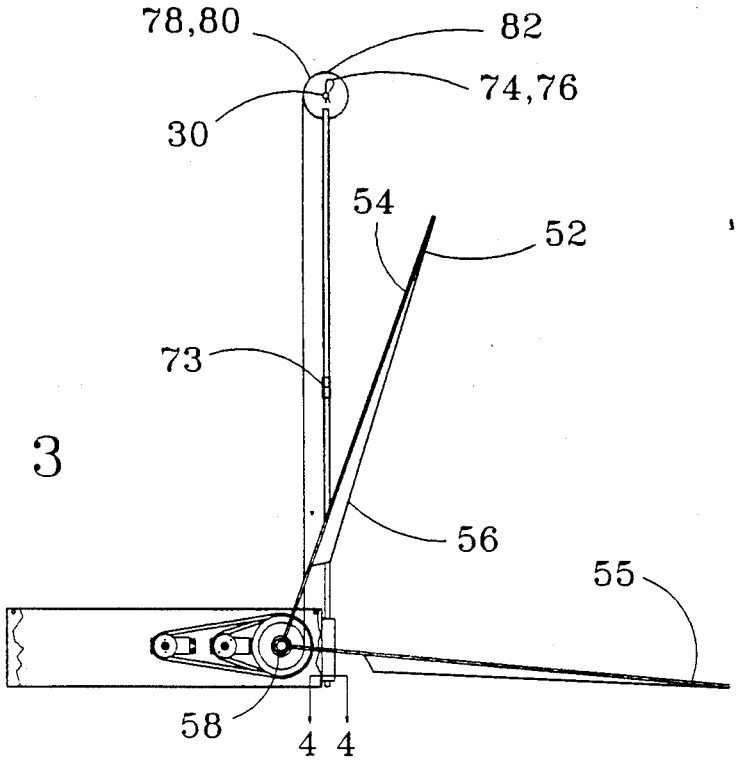
FIG. 3 is a side elevation of the target holder.
Figure 4:
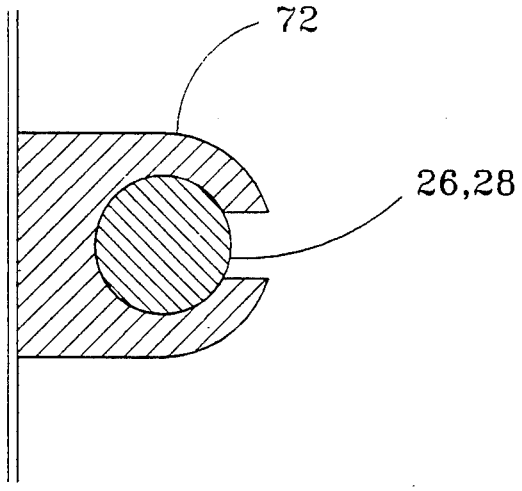
FIG. 4 is an enlarged sectional view taken along line 4—4 of FIG. 3.

As illustrated in FIG. 3, the fully raised panel position is inclined rearwardly approximately 20° from vertical. In use, the shooter may find some less vertical position best suited for the particular existing sunlight conditions. Once the target has been scored, the illumination panel is lowered back to the inactive position 55. The target can then be advanced if necessary to expose a new target enabling the shooter to resume without necessity of walking down to the target to change or score the target. As can be seen in FIG. 5, the illumination panel has a width significantly greater than that of the target so that the illumination panel is clearly visible to the shooter when in the active position. It is important that the illumination panel is visible to the shooter in order to prevent the shooter from inadvertently shooting the illumination panel.

As can be seen from FIGS. 1 and 5, the targets of structure 24 and housing 22 are outboard of the target oriented in the firing position so that projectiles can pass safely through the target without damaging any of the structure of the target holder. As previously described, in order to prevent damage to housing 22, a log 40 or the like may be placed on the ground in front of the target holder to act as a stop. It is therefore advantageous to maintain a very low housing silhouette when viewed along the path of the projectile fired by the shooter. The housing should have a silhouette with a height substantially less than its width, preferably less than one/third of the housing width.

The target holder of the present invention is designed to be very lightweight and easily portable. Unlike target holders of the prior art which also act as a bullet trap, the present invention is specifically designed to let bullets pass through the target without striking the target holder, therefore the structure required is much lighter. Furthermore, the target holder of the present invention can be used with very high powered large caliber rifles which would be totally unsuitable for use with a bullet trap type of target holder of the weight which could be carried by a person.

In spite of one's best efforts, there is still the remote possibility that the target support structure could be inadvertently hit by a projectile. Target support structure is therefore mounted on the rear most portion of the housing and mounted on a rubber fastener illustrated in FIG. 4. Rubber fasteners 72 each have a generally C-shaped elongated slot formed therein for receiving the upright members 26 and 28 therein. In the event the support structure is struck by a projectile, the uprights will deform the rubber fasteners allowing the uprights to disengage from the fasteners without damaging the housing. In the event the support structure is damaged, ideally a limited number of components can be replaced or repaired without any serious inconvenience or expense.

Figure 7:
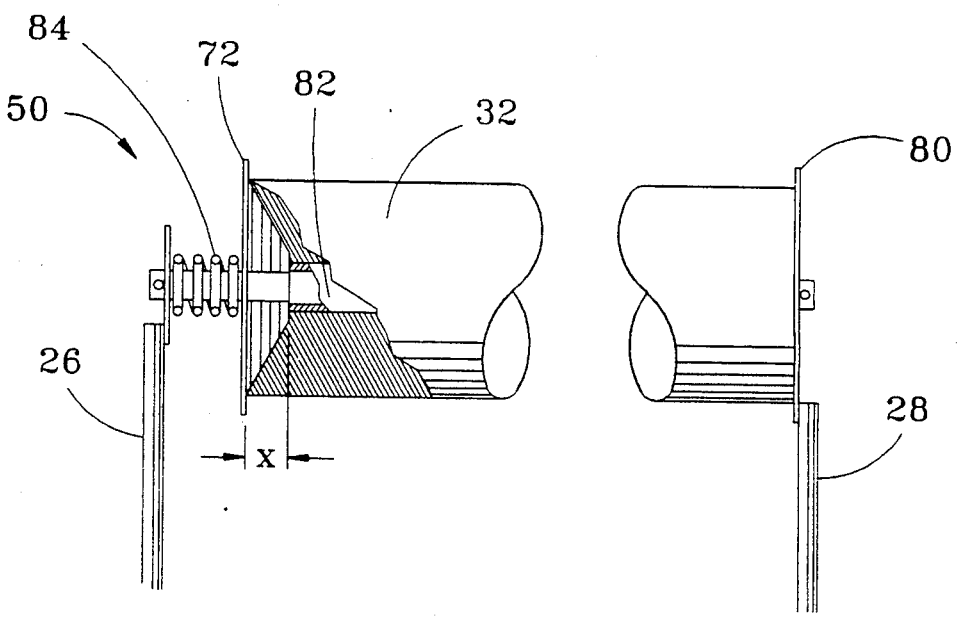
FIG. 7 is an enlarged fragmentary view of the target tensioning mechanism.

As shown in FIGS. 3 and 5, uprights 26 and 28 are each formed in two segments connected centrally by a small ferrule 73. This design is utilized to enable the uprights to be broken down into short lengths which can fit within the housing. When not in use, the entire target holder can be collapsed into the housing which is the general size and shape of a briefcase. Uprights 26 and 28 can be simply removed from the rubber fasteners 72 and horizontal cross member 30 can be disconnected from the uprights by removing hairpin clips 74 and 76. Affixed to the upper ends of uprights 26 and 28 are a pair of disks 78 and 80 having a central hole therein sized to receive horizontal cross member 30. Horizontal cross member 30 has a hole or alternative a groove for receiving a hair pin clip to retain the cross member in place. Roll of targets 32 has a central core 82 about which the elongated paper sheet which forms the target is wound. The core has an internal bore sized to receive the horizontal cross member and then an outer periphery to which one end of the elongated strip of targets is attached. In the preferred embodiment the core is made of a plastic extrusion having an outside diameter of 0.875 inches. A lesser diameter would enable maintaining the proper target tension difficult and a greater diameter would work quite satisfactorily from a tension standpoint, but would needlessly increase the diameter of the full paper roll. Spring 84 is axially compressed between washer 86 and left disk 78 as illustrated in FIG. 7. Spring 84 has loaded in compression thereby exerting an axial load on the roll of targets 34 causing the ends of the roll to bear upon disk 78 and 80. The rate and free length of spring 84 is selected in order to maintain the desired tension on the target strip as it is unwound.

Figure 12:
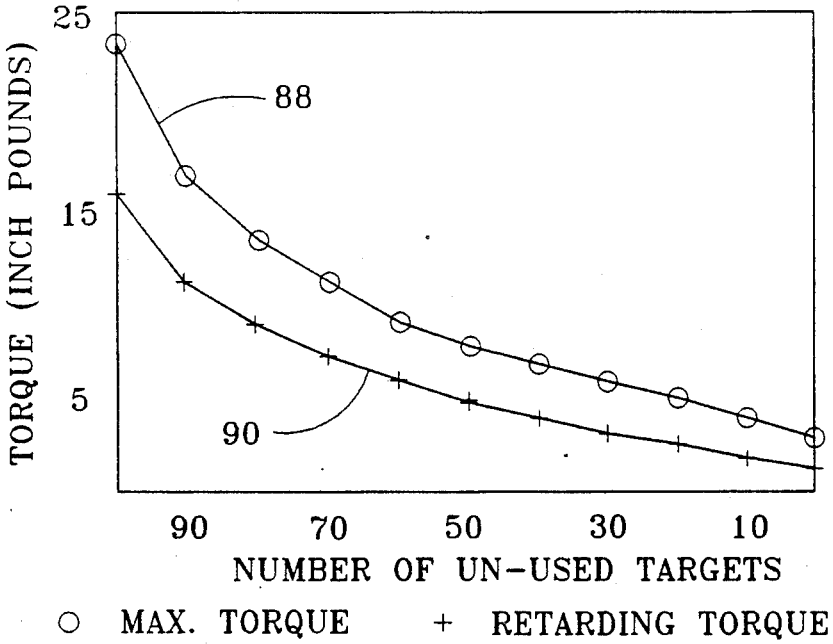
FIG. 12 is a plot of unwinding torque exerted on the target roll and the available torque from the motor as a function of a number of unused targets.

Properly tensioning the target is fairly important if the target holder is to work reliably in windy outdoor conditions. The difficulty in properly tensioning the target is best illustrated with reference to FIG. 9. At the start of the diameter of the roll of targets is relatively large compared to the diameter of the take-up roll. As the targets are used, the take-up roll diameter increases and the roll diameter correspondingly decreases. When the roll core diameter is small, as in the design illustrated, a very significant change in the maximum motor torque available at the roll occurs due to the changing diameters of the take-up roll and the roll of targets. At the start when take-up roll diameter is small and the roll of target diameter is large, a motor has lots of mechanical advantage. When the diameters are reversed, the motor has relatively little mechanical advantage. A plot of maximum motor torque available versus the number of unused targets as shown in curve 88 in FIG. 12 as illustrated. The maximum available torque which a constant torque motor can exert on the roll of targets varies by over a ratio of 5 to 1 as a function of roll diameter. It is not feasible, however, to set a constant retarding torque on the roll which is suitable for all roll diameters. A very low retarding torque would allow wind load exerting on the target from unrolling the target when the target roll is large and mechanical advantage is the greatest. A high enough torque sufficient to withstand wind low and to start on the roll would be too high to enable the motor to overcome the retarding torque unless the motor was excessively oversized. Spring 84 in combination with disks 78 and 80, horizontal cross member 30 serves to provide a variable retarding torque on the roll which generally matches the maximum torque available at the roll. The retarding torque, caused by the friction of the disks 78 and 80 on the ends of the roll, results in a retarding torque which is generally proportional to the inverse of the diameter of the roll of targets squared. The retarding torque, is illustrated as curve 90 in FIG. 10. Ideally, the retarding torque will be 50% to 70% of the maximum torque available to provide sufficient target tension and adequate reserve power for reliable operation.

In order to match the retarding torque curve 90 to the maximum available torque curve 88, it is necessary to decrease the friction force extended on the roll as it unwinds. This is achieved automatically as a result of the novel design of the roll of targets. As illustrated in FIG. 7, one end of the roll of targets has an inwardly beveled surface, therefore, as the roll is unwound, an overall length of the roll decreases. As the roll length decreases, spring 84 extends and the axial force exerted on the roll decreases as the function of the spring rate times the incremental change in length. In the preferred embodiment, the roll of targets has an original diameter of 3.0 inches. One end of the roll is formed in an frusto conical section having a height of 0.35 inches illustrated by the letter "x" in FIG. 7. Spring 84 has a free length of 1.70 inches and a fully compressed length of 0.51 inches and a maximum roll diameter. Spring 84 has a rate of 13.0 pounds per inch causing the axial force exerted on the roll to vary between 8.3 and 3.5 pounds as the roll is unwound.

Figure 8:
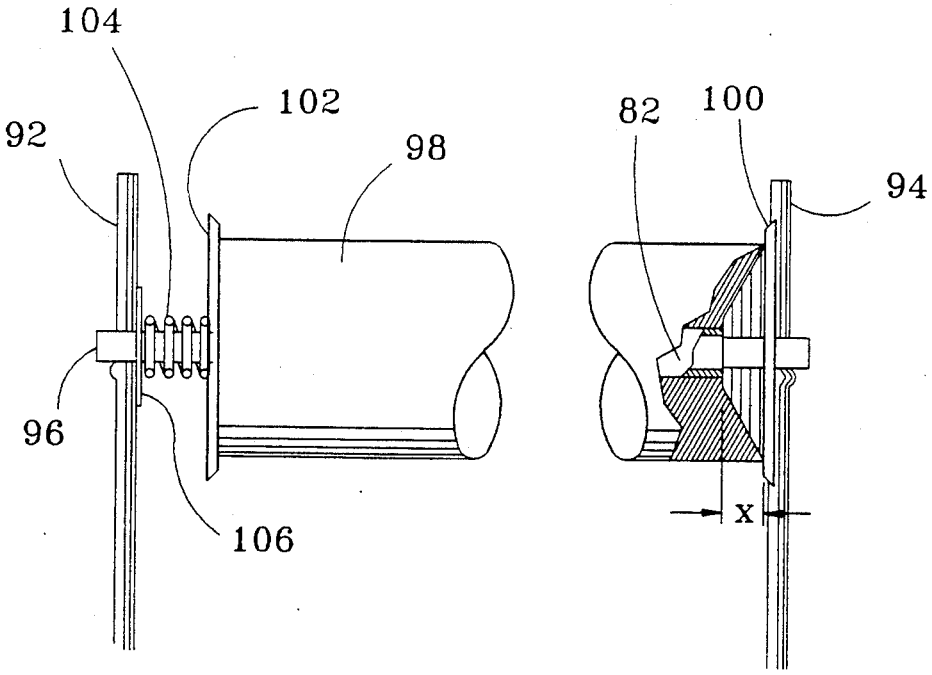
FIG. 8 illustrates a second alternative target tensioning mechanism.

FIG. 8 illustrates a second alternative embodiment of the tensioning mechanism. Uprights 92 and 94 are formed of $\frac{1}{4}$ inch diameter steel rod and horizontal cross member 96 is formed of $\frac{3}{8}$ inch diameter steel rod having a quarter inch hole formed adjacent each end for installation upon the left and right uprights as shown. The uprights 92 have a small stop formed therein in order to position the horizontal cross member 96 as illustrated. A roll of targets 98 is installed on the horizontal cross member in a manner similar to that described previously with reference to the embodiment shown in FIG. 7. Roll 98 is provided with one end which is inwardly beveled so that the life of the roll varies as the roll is unwound. The roll is axially compressed between a fixed disk 100 and a rotatable disk 102 by spring 104. Ideally in order to properly locate the spring and facilitate ease of assembly and disassembly, a washer 106 is positioned between spring 104 and upright 92 as shown. As the roll of paper targets is unwound, disk 102 rotates freely with the roll causing all of the frictional retarding force exerted on the roll to occur at the right end between the outer periphery of the roll and disk 100. Due to the inward bevel of the end of the roll, contact between roll 98 and disk 100 will always occur at substantially maximum roll diameter.

Figure 9:
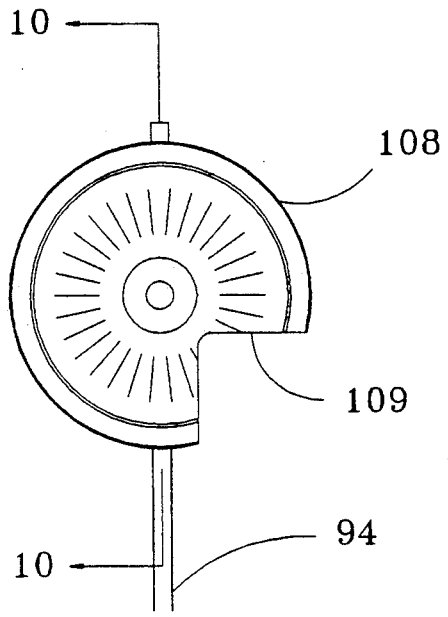
FIG. 9 illustrates a third alternative target tensioning mechanism.
Figure 10:
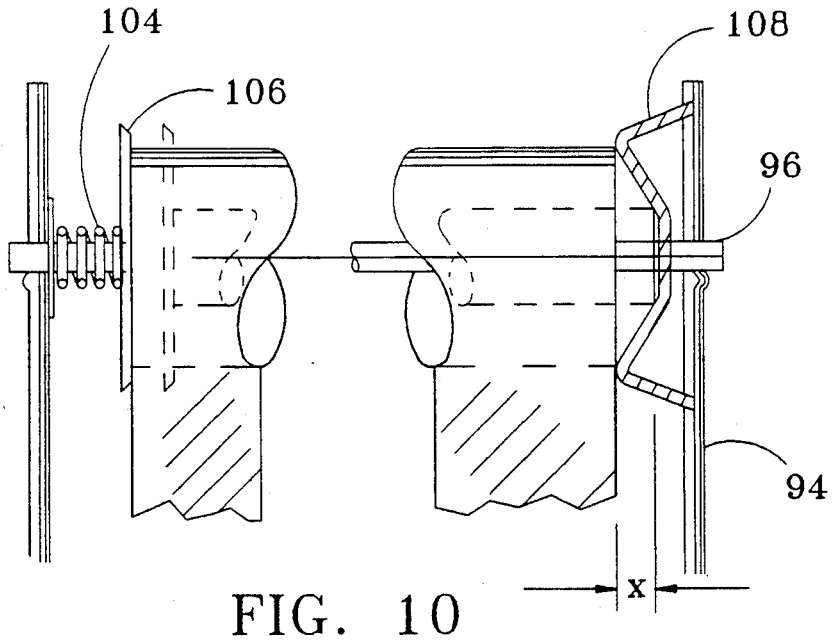
FIG. 10 is a sectional view taken along line 10—10 of FIG. 9.
Figure 11A:
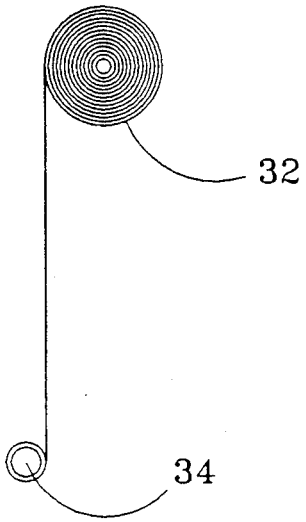
FIGS. 11*a* and 11*b* illustrate the change in roll diameter between the start and end of the roll.
Figure 11B:
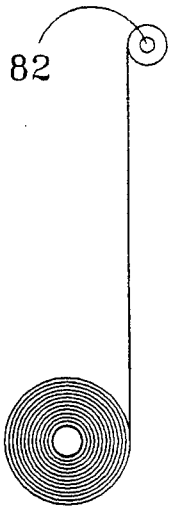

It should be appreciated that while the FIGS. 7 and 8 embodiments utilize rolled inwardly tapered end, alternatively the roll can have vertical ends at both sides and the disk can be frusto conical in shape achieving the same result as shown in the third tensioner embodiment in FIGS. 9 and 10. A frusto conical disk 108 is fixed relative to the upright 94 and is unable to rotate. The frusto conical disk will engage the outer peripheral edge of the paper roll. As the roll unwinds, the relative length of the frusto conical disk paper roll subassembly will vary in a manner similar to the FIGS. 7 and 8 embodiments previously described. The key common feature to all three designs is that the end of the paper roll engages the disk at its outer periphery and the two diverge apart relative to one another at lesser roll radii. Not only does this conical clearance enable the spring to reduce the tension exerted on the roll, this design also maintains the location at which the frictional force is exerted upon the roll at the maximum diameter. This design maximizes retarding torque and makes torque much more consistent than if two flat surfaces were pressed together. A frusto conical disk 108 has preshaped notch 109 removed therefrom to provide clearance for the unwinding roll of paper.

When not in use, the target holder can be knocked down and the components can be neatly fit within the housing. Cover 110 can be removably attached to the housing to enclose the components. Target support structure 24 simply knocks down and fits into the housing. Left and right illumination panel axle frame members 60 and 62 detach from illumination panel axle 58 enabling the frame and the illumination panel 56, which is formed of flexible, fabric to be stored within the storage area in the front of the housing as shown in FIG. 6.

In the center portion of the housing is a compartment for storage of the radio transmitter 112 which is used by the shooter to remotely operate the two drive motors 42 and 66. Also located within the central portion of the housing is receiver 114 which communicates with radio 112 to supply control signals to drive motors 42 and 66. The receiver is powered by a battery 116 which is connected in series to the receiver by on/off switch 118. The receiver has an antenna input lead 120 which can be removably attached to one of the uprights 26 and 28. The uprights are isolated from the housing by rubber fasteners 72 and have a combined length which is approximately ¼ of a wave length. In the preferred embodiment of the invention, the radio receiver operates on a frequency between 75.430 and 75.990 MHz. The radio receiver of the type utilized in the present invention are readily available from a number of sources. Radios and receivers from Futaba of America have been found to work quite satisfactorily in the present application. A number of different discreet frequencies are available so that multiple target holders can be utilized on the same range without interference.

Figure 14:
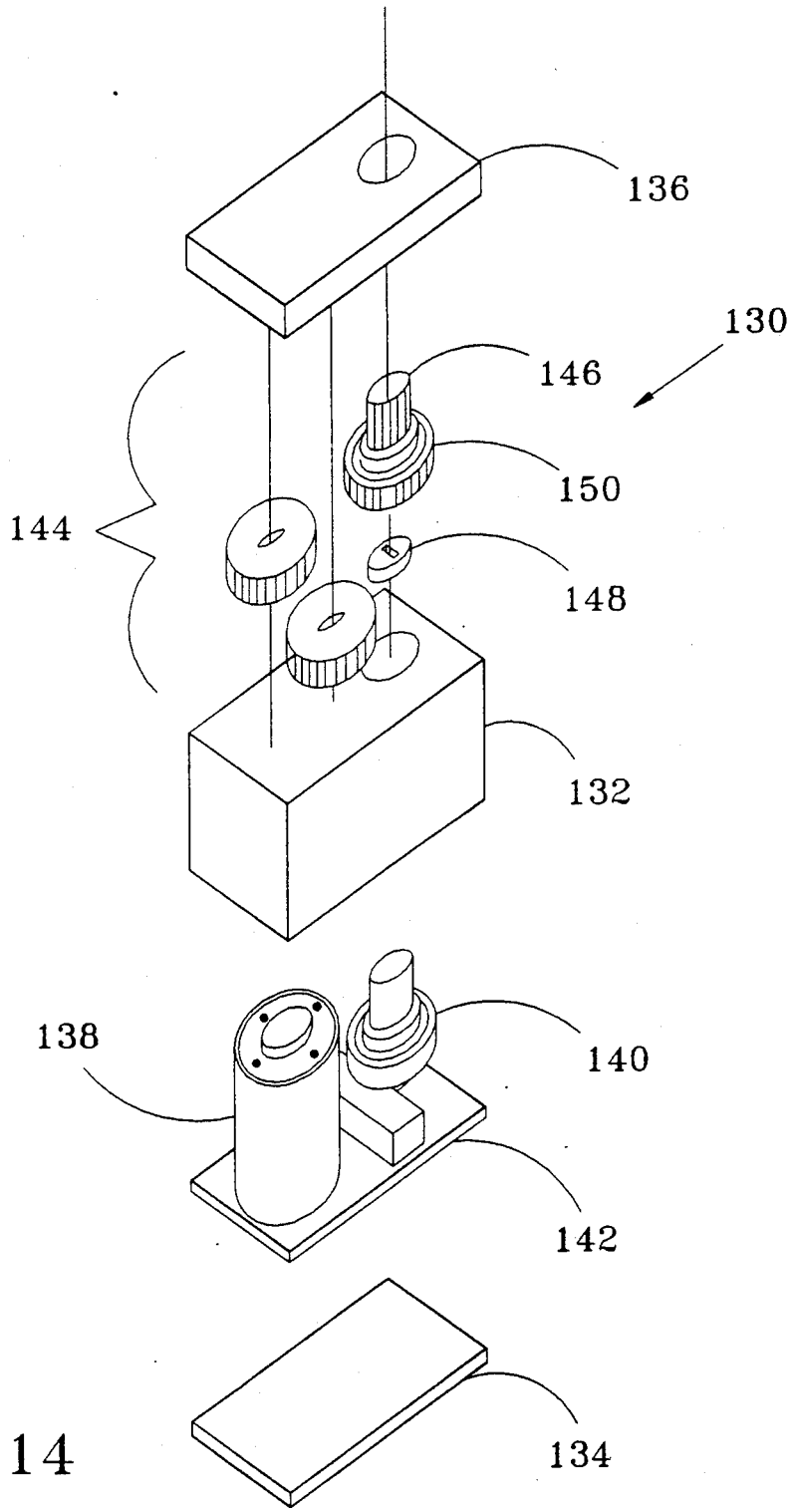
FIG. 14 is an exploded view of the remote control gear motor.
Figure 13:
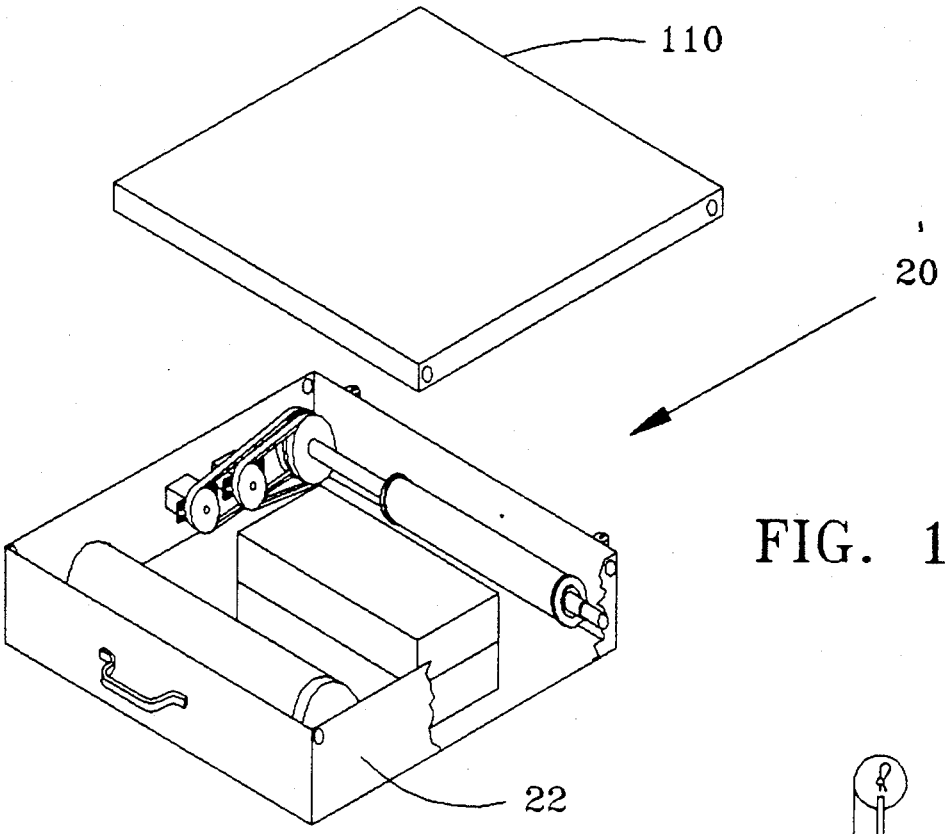
FIG. 13 is a partially exploded perspective view of the target holder in the collapsed storage position.
Figure 15:
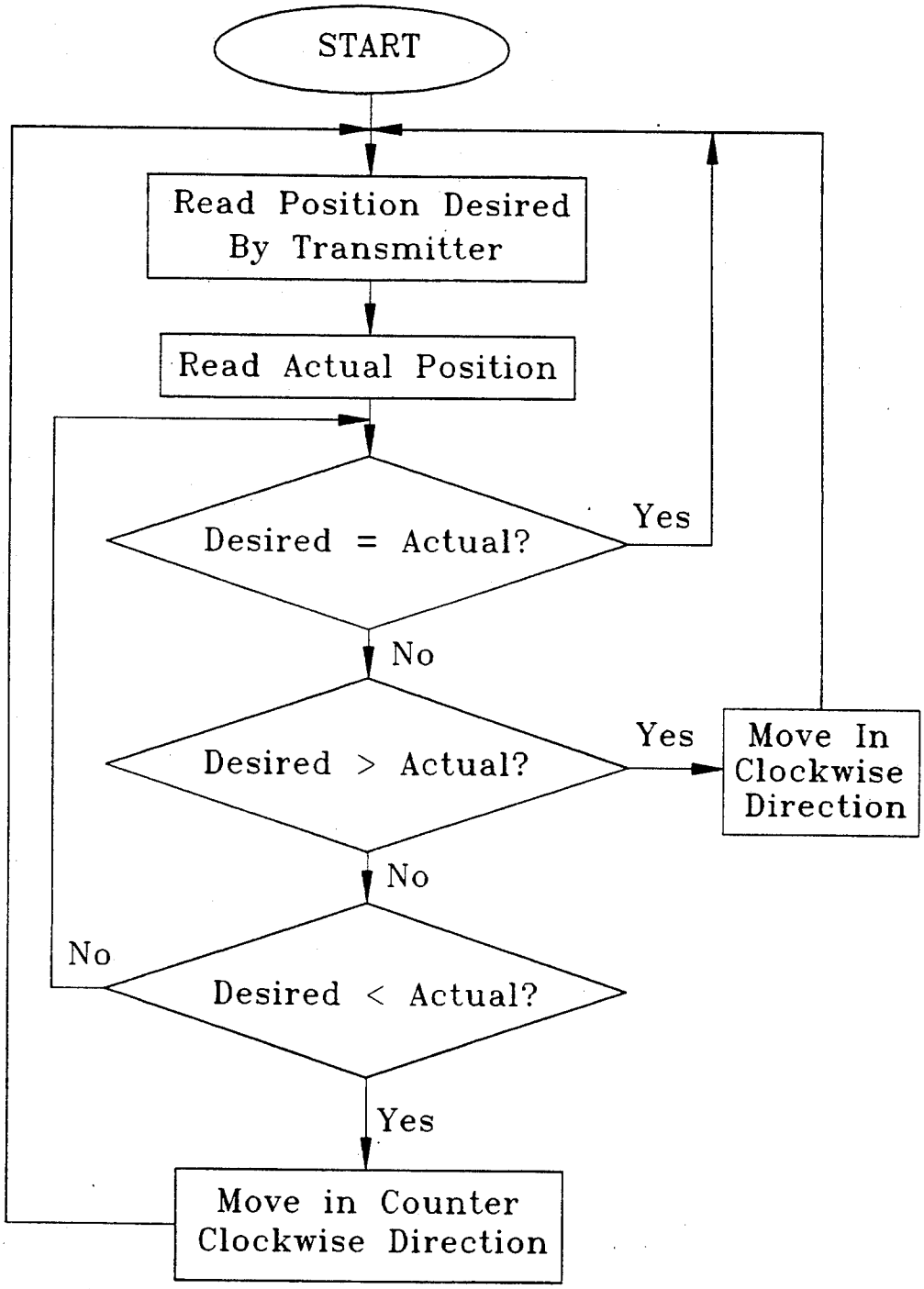
FIG. 15 is a logic diagram illustrating the operation of the gear motor control.

Drive motors 42 and 66 work in cooperation with receiver 114 and radio 112. Radio receiver 112 is provided with two joy stick controllers for operation of drive motors 42 and 66. Each joy stick controller is positioned in a central, neutral position and can be pivoted between an up and down position which causes the motors to run in a clockwise or counter-clockwise direction, respectively. The drive motors include a gear train to reduce the speed of the d.c. motor output and to provide sufficient mechanical advantage. The drive motors in the preferred embodiment are manufactured using a novel method in order to obtain a very low cost remote control d.c. your motor. The gear motor is made by obtaining a remote control servo motor of the type typically used with model radio controlled airplanes. The remote control servo motor has an electric d.c. motor, a gear train having a rotary output shaft and an input shaft driven by the motor as well as rotary position sensor which is coupled to the rotary output shaft. The servo motor also includes a control circuit for regulating the speed and direction of rotation of the motor in response to a remote control signal. Servo motors of this type are designed to rotate the output shaft to a very limited arcuate range. An exploded view of the remote control servo motor 130 is illustrated in FIG. 14 and a schematic diagram of the control circuit logic is illustrated in FIG. 15.

A remote control servo motor 130 includes a three piece housing having a central bottom and top portion 132, 134 and 136, respectively. The central and bottom housing portions define a cavity in which d.c. motor 138, rotary position sensor 140 and control circuit board 142 is oriented. D.C. motor 138 and position sensor 140 have shafts which extend through the housing center section into an upper cavity bounded by the housing center section 132 and the housing top 136. Within the housing upper cavity, is located a series of gears 144 which form a gear train having approximately a 450 to 1 gear reduction. The servo motor, prior to modification, has the gear train output shaft 146 coupled to the position sensor 140 via a drive plate 148. The gear train output shaft can be decoupled from position sensor 140. Gear train output shaft rotatably projects through housing cover 136 to provide rotary output.

The method of making a low cost remote control d.c. motor comprises the steps of partially disassembling the remote control servo motor. The rotary shaft position sensor 140 is then disconnected form the rotary output shaft 146 so that the shaft can move totally independent of the position sensor. The position sensor is then placed in an orientation which will enable the control circuit to maintain the d.c. motor 138 stationary when a neutral input signal is received. The motor is then reassembled thereby enabling the user to alternatively run the motor continuously in either direction. The control circuit 142 works in the manner illustrated in FIG. 15, however, since the rotary position sensor is fixed, logic step 152 "is designated position equal to actual position", will only be met when the radio joy stick is returned to the neutral position. This enables the motor 138 to be freely run in either direction using the same circuit used to freely control a servo system.

In the preferred embodiment of the invention, the drive motors are manufactured by modifying a servo motor sold by Futaba Corporation of America designated as FP-S148. Servo motors of this type include a mechanical stop 150 which limits the angular rotation of the gear train output shaft 146. A step of making the remote control d.c. gear motor therefore necessarily also includes the further step of removing the mechanical stop facilitate free unlimited rotation of the output shaft.

Figure 16:
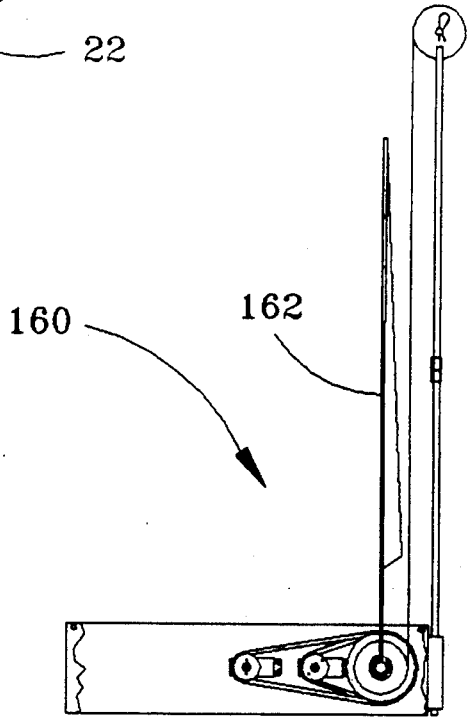
FIG. 16 is a side elevational view of an alternative embodiment for the target holder with a forwardly located cease fire flag.

An alternative embodiment of the target holder 160 is illustrated in FIG. 16. The only difference between FIG. 16 embodiment 20 previously described is the position of panel 162. Panel 20 is oriented in front of the target in the raised position and below the target in the inactive position. Panel 162 is suitable for use when the target holders installed at a range, such as a shooting club or a police station where a number of target holders will be positioned at adjacent stations. In addition to giving a verbal cease-fire command, panel 162 can be raised by the range officer to visually indicate to all of the shooters that it is time to cease fire. Other than the orientation of the drive pulley relative to the driven pulley on the take-up roll in the first embodiment, there are no structural differences on the mechanical hardware. Of course the range officer would have control over all of the target holders to the extent necessary to raise the cease fire flag without the existence of the various shooters.

While the best modes for carrying out the invention have been described in detail, those familiar with the art to which the invention relates will recognize various alternative designs and embodiments for practicing the invention as defined by the following claims.

What is claimed:

1. A target holder for positioning a target for projectiles at a location remote from a shooter, said target holder comprising:

a target support for positioning a target in a substantially vertical planar firing position normal to a path of a projectile fired by a shooter;

an illumination panel movably cooperating with the target support shiftable between an inactive position out of the projectile path and an active position behind the target to increase the visibility of projectile holes formed in the target; and illumination panel drive means cooperating with the illumination panel and the target support for shifting the illumination panel between the active and inactive positions in response to a signal supplied by a remotely located shooter.

2. The target holder of claim 1, wherein the illumination panel is pivotably attached to the target support and rotatable about a horizontal axis generally perpendicular to the path of the projectile.

3. The target holder of claim 2, wherein the illumination panel horizontal axis is located below the target, said illumination panel extending generally horizontally behind the horizontal axis when in the inactive position, and inclined upwardly therefrom when in the active position.

4. The target holder of claim 3, wherein the illumination panel further comprises:

an illumination panel axle pivotably attached to the target support;

an illumination panel frame attached to the illumination panel axle; and an illumination panel sheet mounted to the illumination panel frame.

5. The target holder of claim 4, wherein the illumination panel sheet comprises a fluorescent material.

6. The target holder of claim 1, wherein the target support further comprises a carrier for a roll of targets in a take-up roll which are oriented above and below a target in the firing position which is held therebetween.

7. The target holder of claim 6, wherein the illumination panel further comprises:

an illumination panel axle pivotably attached to the target support;

an illumination panel frame attached to the illumination panel axle; and an illumination panel sheet mounted to the illumination panel frame.

8. The target holder of claim 7, wherein the take-up roll is coaxial with the illumination panel axle.

9. The target holder of claim 8, further comprising target drive means for rotating the take-up roll advancing the target in the firing position to a storage position and on the take-up roll and bringing a new target from the roll of targets into the firing position.

10. The target holder of claim 6, wherein the carrier further comprises tension adjusting means for maintaining the target in the firing position generally taut.

11. The target holder of claim 10 wherein the tension adjusting means varies target tension as a function of the diameter of the roll of targets.

12. The target holder of claim 1, wherein the illumination panel drive means further comprises a radio controlled motor.

13. A target holder for positioning a segment of a roll-type target for projectiles at a location remote from a shooter, said target holder comprising:

a housing for placement on a support surface such as the ground or the like, said housing having a silhouette, when viewed along a path of a projectile fired by a shooter, which is smaller than its width dimension;

a target support structure removably mounted upon the housing for positioning a target in a roll of targets in a firing position generally vertically above the housing in a plane normal to the path of a projectile fired by a shooter, said target support structure and housing oriented relative to the target to provide an unobstructed path for the projectile as it passes through the target segment; and a target drive means located within the housing for advancing the target roll to move a new target to the firing position, said target drive means operable by a shooter at a location remote from the target.

14. The target holder of claim 13, further comprising a take-up roll within the housing cooperating with the support structure to hold the target in the firing position therebetween, wherein the target drive means rotates the take-up roll.

15. The target holder of claim 14, further comprising tensioning means cooperating with the target support structure and target roll for maintaining the target taut.

16. The target holder of claim 14, wherein the target support structure further comprises two uprights and a cross member.

17. The target holder of claim 16, further comprising a breakaway mount attaching the uprights to the housing.

18. The target holder of claim 14, wherein the housing width is greater than the target width.

19. The target holder of claim 14, wherein the housing height is less than one-third the housing width.

20. The target holder of claim 14, wherein the target drive means comprises a radio controlled motor cooperating with the take-up roll to advance target segments.

21. The target holder of claim 20, wherein the target support structure forms an antenna for the radio controlled motor.

22. The target holder of claim 15 wherein the tensioning means comprises:

a follower having a surface for engaging an end of a roll of targets which is inwardly beveled to that the overall length of the roll decreases as the roll of targets is unwound, a follower exerting a frictional force on the roll which resists unwinding; and a spring cooperating with the roll of targets and the follower urging the follower into engagement with the beveled end of the roll of targets wherein the spring relaxes as the roll of targets is unwound.

23. The target holder of claim 22 wherein the spring has a length and a spring rate sufficient to maintain the follower in engagement with the roll of targets and to cause a frictional force exerted on the roll of targets to gradually decrease as the roll of targets is unwound.

24. The target holder of claim 23 wherein the frictional force exerted on the roll of targets is an inverse function of the square of the diameter of the roll of targets.

25. A roll of targets for use in a target machine which has a target tensions which engages an end of the roll of targets as the targets are unwound, the roll of targets comprising:

an elongated strip of paper having a series of targets printed thereon, said elongated strip formed into a cylindrical roll wherein one end of the roll is recessed causing the overall length of the cylindrical roll to decrease as the elongated strip is unwound.

26. The roll of targets of claim 25 wherein the length of the roll decreases at a rate of 0.004 to 0.002 inches per foot.

27. The roll of targets of claim 25 wherein one end of the roll is substantially flat.

28. The roll of targets of claim 25 further comprising a central tubular mandrel upon which the elongated strip is wound.

29. A target holder for positioning a segment of a rolled elongated strip of targets, said target holder comprising:

a support for the roll of targets;

a take-up spool spaced from and parallel to the roll of targets for wrapping the target thereon;

means for driving the take-up spool to advance segments of the elongated strip; and tensioning mean for tensioning the segment of elongated strip of targets extending between the roll of targets and the take-up spool wherein the tension automatically gradually decreases as the roll is unwound.

30. The target holder of claim 29 wherein the tensioning means comprises:

a follower having a surface for engaging an end of a roll of targets which is inwardly beveled to that the overall length of the roll decreases as the roll of targets is unwound, a follower exerting a frictional force on the roll which resists unwinding; and a spring cooperating with the roll of targets and the follower urging the follower into engagement with the beveled end of the roll of targets wherein the spring relaxes as the roll of targets is unwound.

31. The target holder of claim 30 wherein the spring has a length and a spring rate sufficient to maintain the follower in engagement with the roll of targets and to cause a frictional force exerted on the roll of targets to gradually decrease as the roll of targets is unwound.

32. The target holder of claim 30 wherein the frictional force exerted on the roll of targets is an inverse function of the square of the diameter of the roll of targets.

* * * * *